US011482197B2

(12) United States Patent
Ishizaka

(10) Patent No.: US 11,482,197 B2
(45) Date of Patent: Oct. 25, 2022

(54) MUSICAL INSTRUMENT

(71) Applicant: Yamaha Corporation, Hamamatsu (JP)

(72) Inventor: Kenta Ishizaka, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 12 days.

(21) Appl. No.: 17/149,448

(22) Filed: Jan. 14, 2021

(65) Prior Publication Data

US 2021/0134254 A1 May 6, 2021

Related U.S. Application Data

(63) Continuation of application No. PCT/JP2019/028283, filed on Jul. 18, 2019.

(30) Foreign Application Priority Data

Jul. 24, 2018 (JP) ..... JP2018-138216

(51) Int. Cl.

| | |
|---|---|
| ***G10D 3/02*** | (2006.01) |
| ***G10D 3/22*** | (2020.01) |
| ***G10D 1/08*** | (2006.01) |

(52) U.S. Cl.

CPC ..... *G10D 3/02* (2013.01); *G10D 1/085* (2013.01); *G10D 3/22* (2020.02)

(58) Field of Classification Search

CPC ..... G10D 3/02; G10D 3/22; G10D 1/085; G10D 1/08; G10H 3/18

See application file for complete search history.

(56) References Cited

U.S. PATENT DOCUMENTS 827,183 A * 7/1906 Saighman ..... G10C 3/06 84/195
2014/0345441 A1* 11/2014 Ostosh ..... G10D 1/085 84/723
2019/0362693 A1* 11/2019 Dickinson ..... G10D 1/08

FOREIGN PATENT DOCUMENTS

JP 9-127935 A 5/1997
JP 2001-154662 A 6/2001
JP 2016-173431 A 9/2016

OTHER PUBLICATIONS

International Preliminary Report on Patentability (PCT/IB/338 & PCT/IB/373) issued in PCT Application No. PCT/JP2019/028283 dated Feb. 4, 2021, including English translation of document C2 (Japanese-language Written Opinion (PCT/ISA/237) previously filed on Jan. 14, 2021) (eight (8) pages).

International Search Report (PCT/ISA/210) issued in PCT Application No. PCT/JP2019/028283 dated Oct. 1, 2019 with English translation (five (5) pages).

Japanese-language Written Opinion (PCT/ISA/237) issued in PCT Application No. PCT/JP2019/028283 dated Oct. 1, 2019 (four (4) pages).

* cited by examiner

*Primary Examiner* — Kimberly R Lockett
(74) *Attorney, Agent, or Firm* — Crowell & Moring LLP

(57) ABSTRACT

A musical instrument includes a plurality of strings and a body. The body supports the plurality of strings on a first surface of the body. The body includes a groove formed in the first surface that extends linearly. The groove has a constant width and a constant depth.

21 Claims, 6 Drawing Sheets

MUSICAL INSTRUMENT

CROSS REFERENCE TO RELATED APPLICATION

The present application is a continuation application of International Application No. PCT/JP2019/028283, filed on Jul. 18, 2019, which claims priority to Japanese Patent Application No. 2018-138216, filed on Jul. 24, 2018. The contents of these applications are incorporated by reference in their entirety.

BACKGROUND

Technical Field

The present disclosure relates to a musical instrument that includes strings each as a sound generator.

Description of Related Art

Various techniques have been proposed to improve the quality of performance sounds produced by musical instruments such as guitars and violins having strings, each functioning as a sound generator, and a body supporting the strings. For instance, there is a technique of allowing musical instruments such as guitars and violins to produce beautiful and reverberating sounds by forming grooves in the inside of a body board of the musical instruments. In the following description, making performance sounds of a musical instrument beautiful and reverberating will be referred to as enhancing sounding of the musical instrument.

SUMMARY

The above-referenced technique 1 is intended to be applied to a musical instrument whose body is hollow. Thus, the above-referenced technique is not applicable to an electric guitar and an electric bass guitar having a non-hollow body, i.e., a solid body.

Accordingly, one aspect of the present disclosure is directed to a technique of enhancing sounding of a musical instrument having strings each functioning as a sound generator.

In one aspect of the present disclosure, a musical instrument includes: a plurality of strings; and a body supporting the plurality of strings on a first surface of the body, wherein the body includes a groove formed in the first surface that extends linearly, and the groove has a constant width and a constant depth.

BRIEF DESCRIPTION OF THE DRAWINGS

The objects, features, advantages, and technical and industrial significance of the present disclosure will be better understood by reading the following detailed description of embodiments, when considered in connection with the accompanying drawings, in which.

DETAILED DESCRIPTION OF THE EMBODIMENTS

There will be hereinafter described embodiments of the present disclosure.

Figure 1:
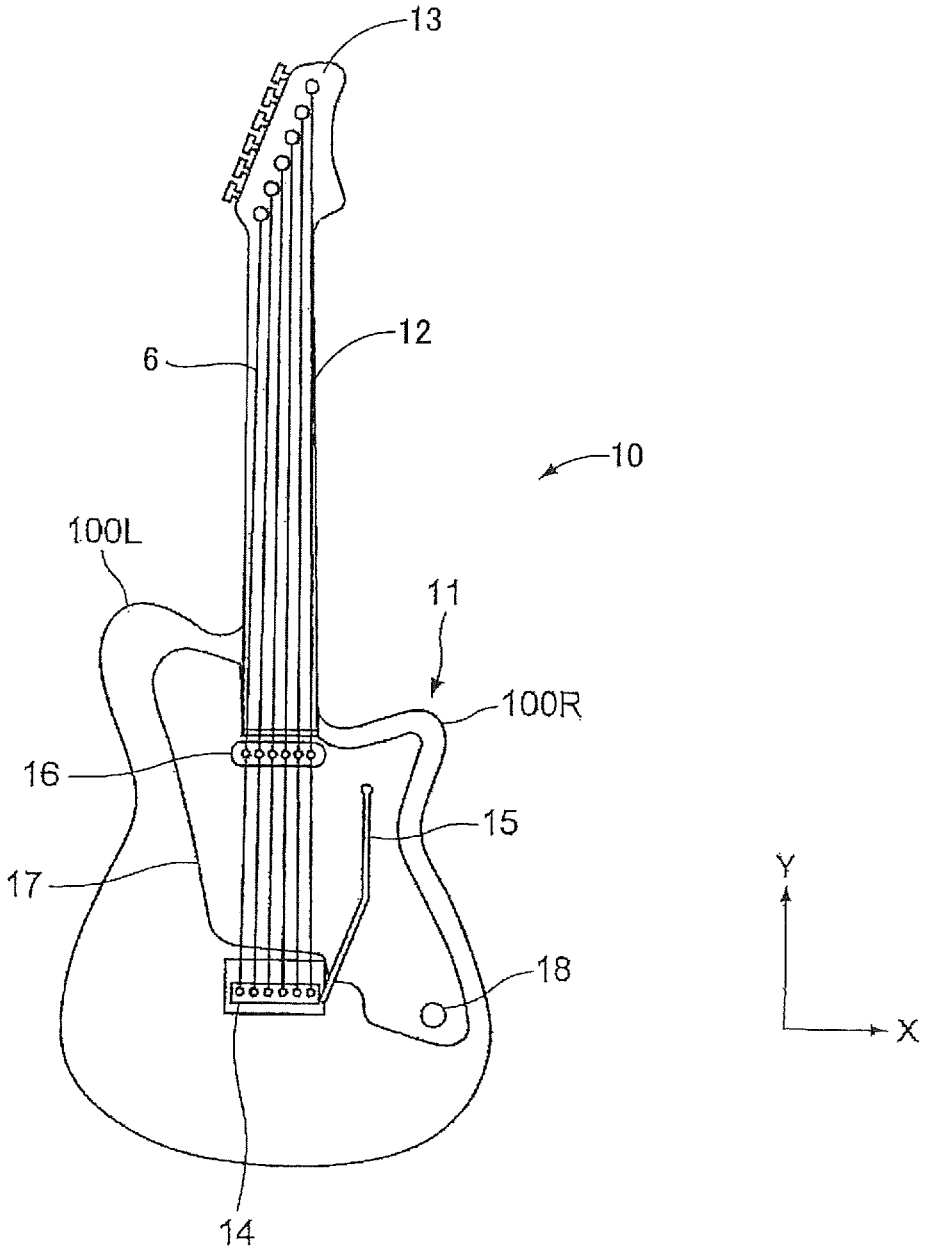
FIG. 1 is a view illustrating an external appearance of an inventive musical instrument.

FIG. 1 is a view illustrating a structure of a musical instrument 10 according to an embodiment.

The musical instrument 10 according to the present embodiment is an electric guitar. As illustrated in FIG. 1, the musical instrument 10 includes a body 11, a neck 12, and a head 13. One and the other end of the neck 12 are connected to the body 11 and the head 13, respectively. A bridge 14 is provided on a top surface of the body 11 that is one of opposite surfaces of the body 11 and that supports a plurality of strings. The top surface is one example of "first surface". Six strings, each of which functions as a sound generator, are tensioned between the bridge 14 and the head 13. In the following description, a direction in which the strings extend will be referred to as "Y direction", and a direction in which the six strings are arranged will be referred to as "X direction" or "right-left direction". The musical instrument 10 of the present embodiment includes the six strings each functioning as the sound generator. The musical instrument according to the present disclosure may include from one to five strings or may include seven or more strings.

The bridge 14 is provided with a tremolo lever 15 for changing the tension of the strings to thereby change the pitch. Though not illustrated in detail in FIG. 1, the neck 12 includes a plurality of frets each as a guide for a pressing position of the strings when a player plays the musical instrument 10 by pressing the six strings with his/her fingers to produce performance sounds at a specific pitch. In the musical instrument 10 of the present embodiment, the number of frets provided on the neck 12 is 20-23. The number of frets may be less than 19 or greater than 24. The frets need not be provided on the neck 12. The tremolo lever 15 need not be provided on the bridge 14.

The six strings have mutually different thicknesses and are referred to as a first string, a second string, a third string, . . . , and a sixth string in order from the thinnest string to the thickest string. In the musical instrument 10 of the present embodiment, the frequencies of the performance sounds when the respective strings (the first through sixth strings) are plucked without being pressed with fingers and without operating the tremolo lever 15 are 330 Hz, 247 Hz, 196 Hz, 147 Hz, 110 Hz, 82 Hz, respectively. The frequencies are not limited to those. When the player plucks any of the six strings of the musical instrument 10, a vibration is generated in the string in accordance with the tension of the string and the position pressed with the finger. The thus generated vibration is converted, by a pickup 16, into an electric signal (hereinafter referred to as "sound signal" where appropriate) representing a waveform of the vibration. The sound signal output from the pickup 16 is amplified by an amplifier incorporated in the body 11 and then sent to an external speaker unit, so that the sound corresponding to the sound signal is output from the external speaker unit. In FIG. 1, illustration of the amplifier and the external speaker unit is omitted.

In addition to the bridge 14, a pickguard 17 is provided on the top surface of the body 11. The pickguard 17 is a plate member formed of resin or metal. The pickguard 17 is provided for preventing the body 11 from being damaged by contact with a pick when the musical instrument 10 is played. On a top surface of the pickguard 17, there are provided the pickup 16 and a volume knob 18 for adjusting a sound volume. The volume knob 18 is an operating member for allowing a player of the musical instrument 10 to determine an amplified amount of the sound signal in the amplifier incorporated in the body 11. The amplifier incorporated in the body 11 amplifies the sound signal output from the pickup 16 in accordance with a rotation angle of the volume knob 18 and outputs the sound signal to the external speaker unit via an audio cable connected to a jack provided on a side surface of the body 11. In FIG. 1, illustration of the jack on the side surface of the body 11 is omitted.

Figure 2:
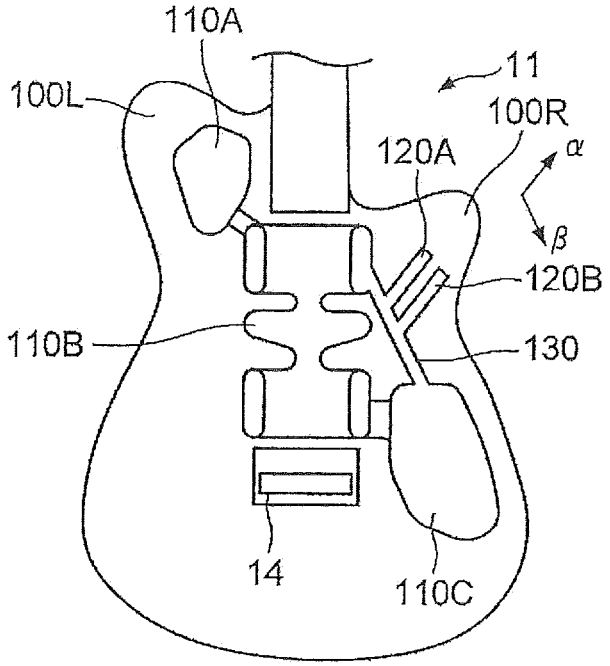
FIG. 2 is a plan view of a body of the inventive musical instrument.

FIG. 2 is a plan view of the body 11 from which the pickguard 17 is removed.

The body 11 is a solid member formed of wood or resin. The body 11 includes a corner portion 100R and a corner portion 100L that protrude asymmetrically with respect to the neck 12 when the neck 12 is regarded as a center in the right-left direction. In the present embodiment, the corner portion 100L protrudes more largely than the corner portion 100R, as illustrated in FIGS. 1 and 2. The body 11 includes a recess 110A, a recess 110B, and a recess 110C for accommodating an electronic circuit such as the amplifier for amplifying the sound signal output from the pickup 16.

In addition, a groove 120A, a groove 120B, and a groove 130 are formed in the top surface of the body 11 in the vicinity of a base portion of the corner portion 100R. The groove 120A and the groove 120B extend in a protruding direction of the corner portion 100R, i.e., a direction in FIG. 2, (as one example of a direction that intersects the Y direction in which the strings 6 extend). The groove 130 extends in a direction that intersects the protruding direction of the corner portion 100R, i.e., β direction in FIG. 2, (as one example of the direction that intersects the Y direction in which the strings 6 extend). Where it is not necessary to distinguish the groove 120A and the groove 120B from each other, the groove 120A and the groove 120B will be hereinafter referred to as "groove 120". The grooves 120A, 120B, 130 are formed so as to extend linearly. Each of the grooves 120A, 120B, 130 has a width and a depth constant over a range in which the groove 120A, 120B, 130 linearly extends. As illustrated in FIG. 2, one end of the groove 130 reaches the recess 110B, namely, one end of the groove 130 is connected to the recess 110B, and the other end of the groove 130 reaches the recess 110C, namely, the other end of the groove 130 is connected to the recess 110C. One of opposite ends of the groove 120 reaches the groove 130, namely, one of opposite ends of the groove 120 is connected to the groove 130. That is, the groove 120 branches off from the groove 130. The present embodiment is characterized by providing the grooves 120, 130 in the vicinity of the base portion of the corner portion 100R. The reasons why the grooves 120, 130 are provided in the vicinity of the corner portion 100R are as follows.

Figure 3:
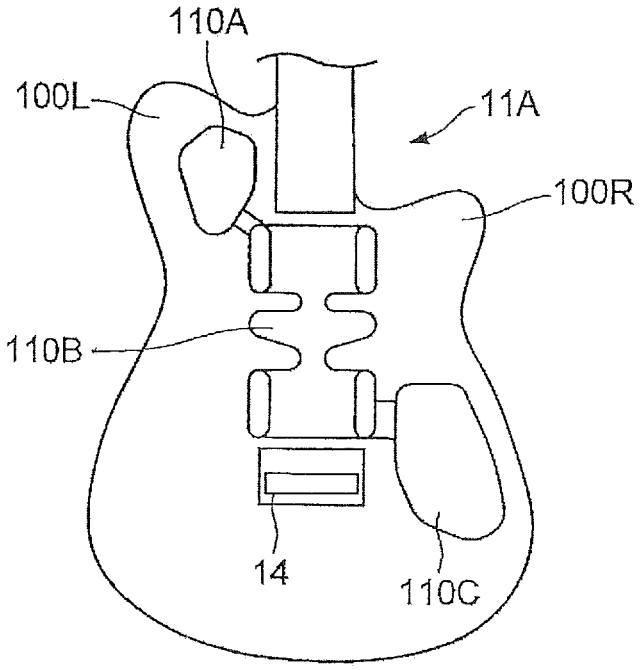
FIG. 3 is a plan view of a body in which no grooves are formed.
Figure 4:
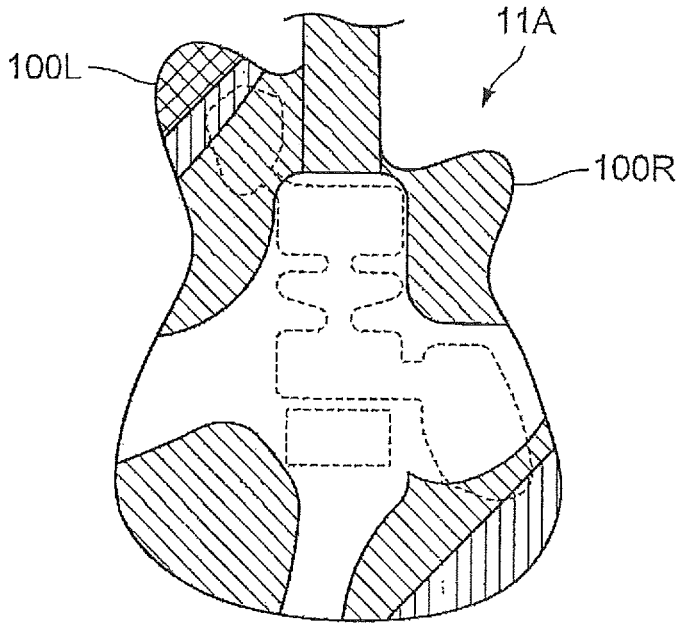
FIG. 4 is a schematic view representing magnitude of a vibration at various portions of the body in different hatching patterns.

The vibration generated in each string when the string is plucked with a pick, for instance, is transmitted to the body 11 via the bridge 14, so that the body 11 is vibrated. The applicant of the present disclosure has found by experiments that the vibration generated in the body 11 in accordance with the vibration of the strings influences the performance sounds of the musical instrument. Specifically, the applicant of the present disclosure has conducted experiments on a body 11A (FIG. 3) having the corner portion 100L and the corner portion 100R like the body 11 but not having the grooves 120, 130 and has found that a vibration generated in the body 11A in accordance with the vibration of the strings suffers from nonuniformity. Here, "the vibration generated in the body in accordance with the vibration of the strings suffers from nonuniformity" means as follows. That is, the body largely vibrates at a certain portion thereof in accordance with the vibration of the strings whereas the body does not vibrate so much at some other portion. Thus, the magnitude of the vibration in accordance with the vibration of the strings varies portion to portion of the body. FIG. 4 is a schematic view illustrating, in different hatching patterns, the magnitude of the vibration generated at various portions of the body 11A when a vibration having a frequency of 331 Hz is applied to the body 11A. In FIG. 4, the outline of each of the recess 110A, the recess 110B, the recess 110C, and the bridge 14 is indicated by the dotted line. In FIG. 4, a double cross-hatched region indicates a portion in which the magnitude of the vibration is the largest, a vertically hatched region indicates a portion in which the magnitude of the vibration is the second largest, and a single cross-hatched region indicates a portion in which the magnitude of the vibration is the third largest. In FIG. 4, a non-hatched region indicates a portion that hardly vibrates.

As apparent from FIG. 4, the corner portion 100L more largely vibrates than the corner portion 100R when the vibration having a frequency of 331 Hz is applied to the body 11A. It has been found that the corner portion 100R more largely vibrates than the corner portion 100L when a vibration having a frequency of 346 Hz is applied to the body 11A, contrary to the example illustrated in FIG. 4. It is to be understood from the experiment results that the frequency of the basic mode (the natural frequency) differs between the corner portion 100R and the corner portion 100L, and it is to be further understood that the natural frequency of the corner portion 100R is higher than the natural frequency of the corner portion 100L.

The applicant of the present disclosure has considered that the difference in the natural frequency between the corner portion 100R and the corner portion 100L of the body 11A is due to a difference in deflection stiffness (hereinafter simply referred to as "stiffness") between the two corner portions 100R, 100L that arises from the asymmetrical shape of the body 11A, namely, due to the stiffness of the corner portion 100R higher than that of the corner portion 100L. For enhancing the sounding of the musical instrument having the strings and the body supporting the strings, it is preferable that the entirety of the body uniformly vibrates in accordance with the vibrations of the strings. In view of this, the applicant of the present disclosure has conceived providing the grooves 120, 130 in the vicinity of the corner portion 100R for lowering the natural frequency of the corner portion 100R by lowering the stiffness thereof.

Figure 5:
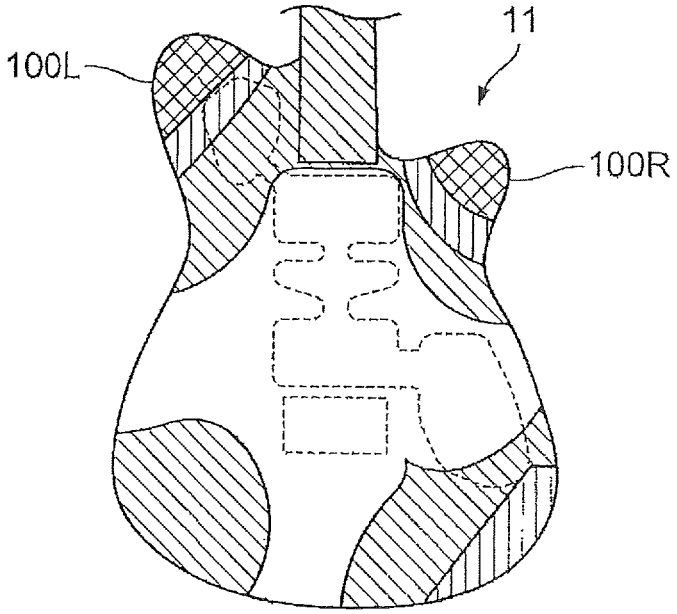
FIG. 5 is a schematic view representing magnitude of a vibration at various portions of the body in different hatching patterns.

FIG. 5 is a schematic view illustrating, in different hatching patterns, the magnitude of the vibration generated at various portions of the body 11 when the vibration having a frequency of 331 Hz is applied to the body 11. In FIG. 5, the magnitude of the vibration is indicated by the hatching patterns as in FIG. 4, and the outline of each of the recess 110A, the recess 110B, the recess 110C, and the bridge 14 is indicated by the dotted line. In FIG. 5, illustration of the outline of each of the groove 120A, the groove 120B, and the groove 130 is omitted for the sake of brevity. As apparent from FIG. 5, when the vibration having a frequency of 331 Hz is applied to the body 11, the magnitude of the vibration of the corner portion 100L and the magnitude of the vibration of the corner portion 100R are substantially equal. This means that the stiffness of the corner portion 100R is lowered and the natural frequency thereof is lowered down to around the natural frequency of the corner portion 100L. If the natural frequency of the corner portion 100R and the natural frequency of the corner portion 100L are equal, it is expected that the corner portion 100L and the corner portion 100R vibrate equally at a higher frequency, namely, it is expected that the vibration characteristics of the corner portion 100L and the vibration characteristics of the corner portion 100R approximate to each other, in other words, are substantially identical to each other.

Figure 6:
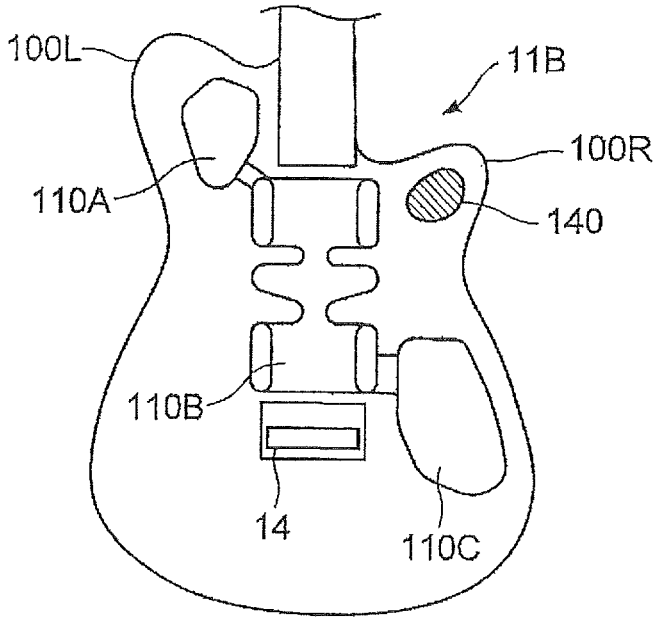
FIG. 6 is a plan view of a body in which a recess is formed in place of the groove, the groove, and the groove.

Lowering the stiffness of the corner portion 100R may be achieved by forming a recess 140, which is similar to the recesses 110A-110C, at the corner portion 100R in a body 11B illustrated in FIG. 6, for instance. In the body 11B in which the recess 140 is formed at the corner portion 100R as illustrated in FIG. 6, however, the mass of the corner portion 100R is lowered, resulting in an increase in the natural frequency. It is thus preferable to provide the grooves 120, 130 in the vicinity of the base portion of the corner portion 100R as illustrated in FIG. 2.

As explained above, the grooves 120, 130 are provided at the base portion of one of the asymmetrically protruding corner portions 100R, 100L that has higher stiffness, so that the vibration characteristics of the asymmetrically protruding two corner portions 100R, 100L, which are located at mutually different positions in the right-left direction of the body 11, are substantially identical to each other and the entirety of the body 11 uniformly vibrates in accordance with the vibration of the strings. In other words, the vibration characteristics of the right-hand portion of the body 11 corresponding to the corner portion 100R and the vibration characteristics of the left-hand portion of the body 11 corresponding to the corner portion 100L are substantially identical to each other. This means that the natural frequency in the basic mode is substantially identical and the magnitude of the vibration (i.e., the amplitude) is substantially identical, between the left-hand portion and the right-hand portion of the body 11. Since the vibration characteristics of the left-hand portion of the body 11 (the corner portion 100L) and the vibration characteristics of the right-hand portion of the body 11 (the corner portion 100R) are substantially identical to each other, the musical instrument can sound better, as compared with a configuration in which the grooves 120, 130 are not provided. That is, the present embodiment ensures enhanced sounding of the musical instrument having the strings, each functioning as the sound generator, and the body supporting the strings. In a state in which the pickguard 17 is attached to the body 11, the grooves 120, 130 are hidden by the pickguard 17 and accordingly invisible. Thus, provision of the grooves 120, 130 on the body 11 does not influence the external appearance of the musical instrument 10. The player of the electric guitar such as a rock singer often demands, in addition to good sounding of the musical instrument, good external appearance of the musical instrument, in terms of impressive or attractive looking on stage. In the present embodiment, the external appearance of the musical instrument 10 is not influenced. It is thus possible to satisfy needs of the player who demands good external appearance as well as good sounding. The present embodiment enables the sounding of the musical instrument to be enhanced while avoiding giving an influence on the external appearance of the musical instrument having the strings, each functioning as the sound generator, and the body supporting the strings.

Figure 8:
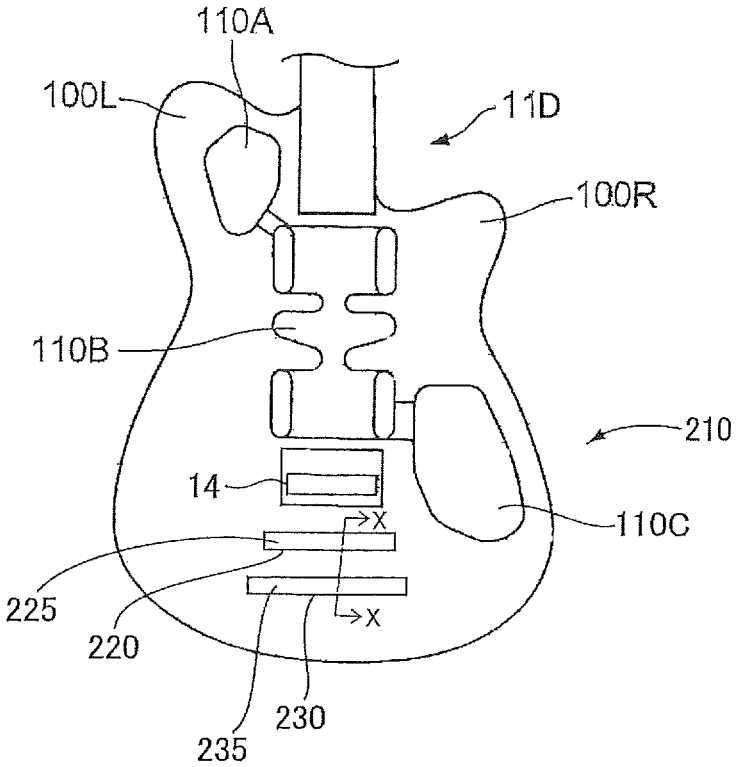
FIG. 8 is a view illustrating an external appearance of a body of an inventive musical instrument.
Figure 9:
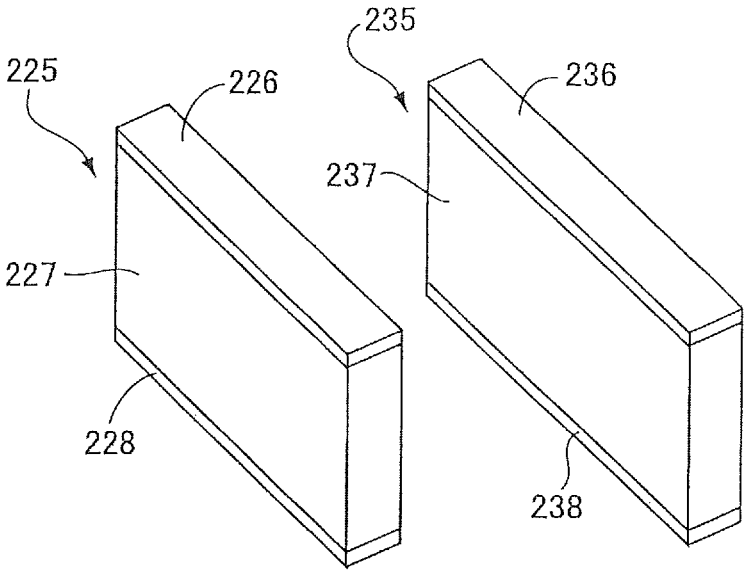
FIG. 9 is a perspective view of insertion members.
Figure 10:
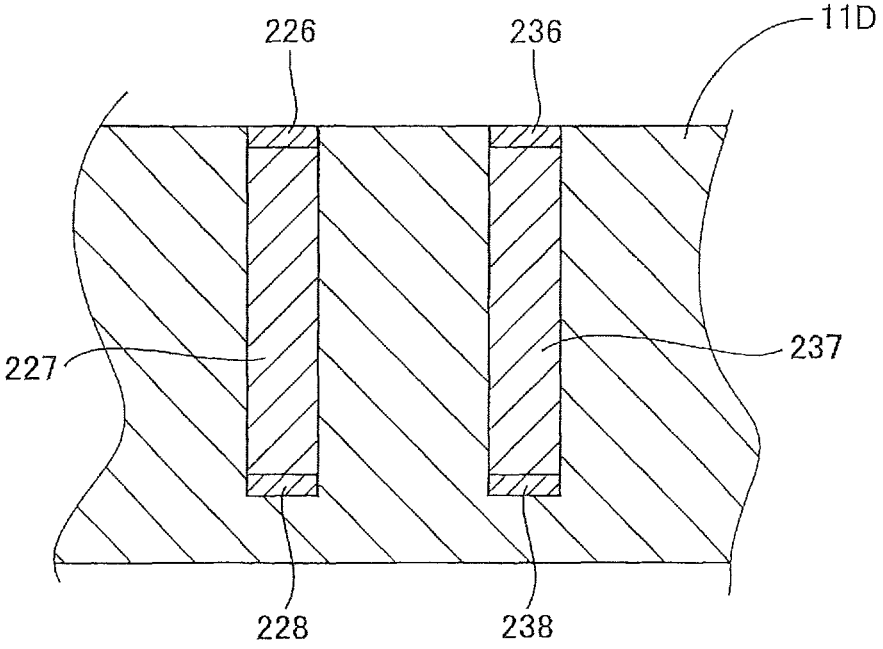
FIG. 10 is a cross-sectional view of the insertion members.

Referring next to FIGS. 8-10, there will be explained an alternate embodiment. The same reference numerals as used in the previous embodiment are used to identify the corresponding components of a musical instrument 210 of the present embodiment, and explanation of the components is dispensed with. The musical instrument 210 includes a head, a neck, a bridge, strings, a tremolo lever, a pickup, a pickguard, and a volume knob similar to those of the musical instrument 10 of the previous embodiment.

Two grooves 220, 230 are formed in the top surface of a body 11D of the musical instrument 210 according to the present embodiment. The two grooves 220, 230 linearly extend in a direction in which the strings are arranged, namely, in the X direction. The groove 220 is formed at a position spaced apart from the bridge 14, and the groove 230 is formed at a position spaced apart from the groove 220 so as to extend in parallel with the groove 220. The length of the groove 220 in the X direction is larger than the length of the bridge 14 in the X direction. The length of the groove 230 in the X direction is in a range from 50 mm to 60 mm and is larger than the length of the groove 220 in the X direction. The direction in which the grooves 220, 230 extend may be other than the X direction. For instance, the direction in which the grooves 220, 230 extend may intersect the direction in which the strings extend. The length of the groove 220 in the X direction and the length of the groove 230 in the X direction may be the same or the length of the groove 220 in the X direction may be larger than the length of the groove 230 in the X direction.

Each of the grooves 220, 230 has a constant width and a constant depth over a range in which each groove 220, 230 linearly extends, and the width and the depth of the groove 220 are the same as the width and the depth of the groove 230. At least one of the width and the depth may be made different between the groove 220 and the groove 230.

Insertion members 225, 235 are fitted in the groove 220 and the groove 230, respectively. As illustrated in FIG. 9, the insertion member 225 (as one example of "first member") includes a carbon plate 226 (as one example of "first stiffness portion"), mahogany 227 (as one example of "second stiffness portion"), and a carbon plate 228 (as one example of "third stiffness portion"). Each of the carbon plates 226, 228 is a plate-like carbon fiber reinforced plastic (CFRP). The carbon plates 226, 228 are respectively fixed to one and the other of opposite surfaces (the top surface and the back surface) of the mahogany 227 by an adhesive. Similarly, the insertion member 235 (as one example of "first member") includes a carbon plate 236 (as one example of "first stiffness portion"), mahogany 237 (as one example of "second stiffness portion"), and a carbon plate 238 (as one example of "third stiffness portion"). Each of the carbon plates 236, 238 is a plate-like carbon fiber reinforced plastic. The carbon plates 236, 238 are respectively fixed to one and the other of opposite surfaces (the top surface and the back surface) of the mahogany 237 by an adhesive. Each insertion member 225, 235 has a width, a length, and a thickness (that is a length corresponding to a depth direction of the grooves 220, 230) that are equal to or slightly smaller than the width, the length, and the depth of the corresponding groove 220, 230. For instance, the length of the insertion member 235 in the longitudinal direction is in a range from about 50 mm to about 60 mm and is larger than the length of the insertion member 225 in the longitudinal direction. The thickness of each carbon plate 226, 228, 236, 238 is in a range from about 2 mm to about 3 mm, and the thickness of each mahogany 227, 237 (that is a distance from the top surface to the back surface of the mahogany 227, 237) is about 30 mm, for instance.

As illustrated in FIGS. 8 and 10, the insertion members 225, 235 are fitted in the respective grooves 220, 230, and portions of the insertion members 225, 235 embedded in the grooves 220, 230 are fixed to the body 11D by the adhesive, so that the insertion members 225, 235 are made integral with the body 11D. That is, the insertion members 225, 235 vibrate, as part of the body 11D, integrally with the body 11D. As illustrated in FIG. 10, in the state in which the insertion members 225, 235 are fitted in the respective grooves 220, 230 and fixed to the body 11D, the top surfaces of the carbon plates 226, 236 are located at the same position as the top surface of the body 11D in the depth direction of the grooves 220, 230. In other words, the top surfaces of the carbon plates 226, 236 are flush with the top surface of the body 11D. With this configuration, the carbon plates 226, 236 vibrate integrally with the top surface of the body 11D. Further, the back surfaces of the carbon plates 228, 238 are located at a position close to the back surface of the body 11D in the depth direction of the grooves 220, 230. With this configuration, the carbon plates 228, 238 vibrate integrally with the back surface of the body 11D. The carbon fiber reinforced plastic of which the carbon plates 226, 228, 236, 238 are formed has stiffness considerably higher than that of wood or resin of which the body 11D is formed. Thus, the stiffness of a portion of the body 11D at which the grooves 220, 230 are formed and the insertion members 225, 235 are disposed is higher than the stiffness of other portion of the body 11D. By thus allowing the portion of the body 11D to have stiffness higher than that of other portion, the vibration characteristics of the body 11D can be controlled, making it possible to enhance the sounding of the musical instrument having the strings, each functioning as the sound generator, and the body supporting the strings. The positions of the grooves 220, 230 on the body 11D may be suitably changed, and the length, the width, and the depth of each of the grooves 220, 230 may be suitably changed. Only one of the carbon plates 226, 228 may be used.

In the present embodiment, the length, the width, and the thickness of each insertion member 225, 235 are made equal to or slightly smaller than those of the corresponding groove 220, 230. The length, the width, and the depth of the insertion member may be made smaller than those of the groove as long as the insertion member can be made integral with the body and the vibration characteristics of the body are controllable. For instance, the insertion members may be fitted in the recess 110C in FIG. 8, and the insertion members may be fixed to the bottom of the recess 110C to control the vibration characteristics of the recess 110C of the body.

The length and the width of the insertion member may be made slightly larger than those of the groove, and the insertion member may be press-fitted in the groove to make the insertion member integral with the body.

In the present embodiment, the insertion member is formed of the carbon plates and the mahogany. The insertion member may be formed of other material that enables the insertion member to have stiffness higher than the stiffness of the body. For instance, the insertion member may be formed of metal or the like having stiffness higher than that of wood or resin of which the body is formed.

There have been explained above embodiments of the present disclosure. Other embodiments may be considered.

(1) In the illustrated embodiment, the grooves 120, 130 are covered with and hidden by the pickguard 17 in the state in which the pickguard 17 is attached to the body 11. The grooves 120, 130 need not necessarily be covered with and hidden by the pickguard 17. In the state in which the pickguard 17 is attached to the body 11, the groove 120 or the groove 130 may partly extend outside the pickguard 17. It is noted that the outline of the planar shape of the body 11 is the same as that of the body 11 not having the grooves 120, 130. Thus, even if the groove 120 or the groove 130 is partly or entirely exposed to the outside, the external appearance of the musical instrument having the body 11 is less likely to be influenced.

(2) In the illustrated embodiment, one end of the groove 130 reaches or is connected to the recess 110B, and the other end of the groove 130 reaches or is connected to the recess 110C. The one end of the groove 130 need not necessarily reach the recess 110B, and the other end of the groove 130 need not necessarily reach the recess 110C. Similarly, one end of the groove 120 need not necessarily reach the groove 130, namely, the groove 120 need not necessarily branch off from the groove 130. That is, the length of each groove 120, 130 may be determined such that the vibration characteristics of the right-hand portion of the body 11 (corresponding to the corner portion 100R) and the vibration characteristics of the left-hand portion of the body 11 (corresponding to the corner portion 100L) are substantially identical to each other while taking account of: the mass of the corner portion 100R that is reduced by increasing the length of the groove; and the lowered amount of the stiffness of the corner portion 100R (the lowered amount of the natural frequency of the corner portion 100R). The width and the depth of the grooves 120, 130 may be similarly determined. In the illustrated embodiment, the grooves 120, 130 linearly extend. The grooves 120, 130 may extend so as to be curved. The depth or the width of the grooves 120, 130 need not necessarily be constant. The depth may vary in the direction in which each groove extends. The shape, the length, the width, and the depth of each groove 120, 130 may be suitably determined as long as the vibration characteristics are identical between the right-hand portion and the left-hand portion of the body 11.

(3) In the body 11 of the illustrated embodiment, one of the asymmetrically protruding corner portions 100L, 100R that has higher stiffness (that has a higher natural frequency) is provided with the grooves 120A, 120B extending in the protruding direction of the one corner portion and the groove 130 extending in the direction intersecting the protruding direction, such that the grooves 120A, 120B, 130 are formed at the base portion of that one corner portion. Only one groove 120 may be provided or three or more grooves 120 may be provided. The lowered amount of the stiffness of the corner portion increases with an increase in the number of the grooves 120. The number of the grooves 120 may be suitably determined such that the vibration characteristics are identical between the right-hand portion of the body 11 (the corner portion 100R) and the left-hand portion of the body 11 (the corner portion 100 L) while taking account of: the mass of the corner portion that is reduced by increasing the number of the grooves 120; and the lowered amount of the stiffness of the corner portion in question. Similarly, a plurality of the grooves 130 may be provided in the vicinity of the base portion of the one of the corner portions having higher stiffness. The number of the grooves 120 and the number of the grooves 130 may be suitably determined as long as the vibration characteristics are identical between the right-hand portion and the left-hand portion of the body 11.

(4) In the illustrated embodiment, both the groove 120 and the groove 130 are provided in the vicinity of the base portion of the one of the corner portions having higher stiffness. Either the groove 120 or the groove 130 may be provided. Both the groove 120 and the groove 130 may be provided at the base portion of the one of the corner portions having higher stiffness while any one of the groove 120 and the groove 130 may be provided at the base portion of the other corner portion having lower stiffness. This configuration enables fine adjustment of the vibration characteristics of the body 11 in the right-left direction, as compared with the configuration in which the grooves are provided only at the base portion of the one of the corner portions having higher stiffness. That is, the type and the number of the grooves, i.e., the layout of the grooves, may be suitably determined such that the vibration characteristics of the right-hand portion of the body 11 (corresponding to the corner portion 100R) and the vibration characteristics of the left-hand portion of the body 11 (corresponding to the corner portion 100L) are substantially identical to each other while taking account of: the mass of the corner portion that is reduced by providing the grooves; and the lowered amount of the stiffness of the corner portion in question.

(5) The body 11 of the illustrated embodiments includes the two asymmetrically protruding corner portions. The principle of the present disclosure is applicable to a musical instrument including the strings and a body that supports the strings and that has three or more asymmetrically protruding corner portions. In this instance, one or more groove may be provided at the base portion of one of a plurality of corner portions having the highest stiffness for lowering the stiffness of the one corner portion, and one or more groove may be provided at the base portion of at least one other corner portion, except for the one corner portion having the highest stiffness, for lowering the stiffness of the at least one other corner portion, for allowing substantially uniform vibration characteristics of the entire body in a direction intersecting the direction in which the strings extend. This configuration enhances the sounding of the musical instrument having the strings and the body that supports the strings and that has the three or more asymmetrically protruding corner portions.

Figure 7:
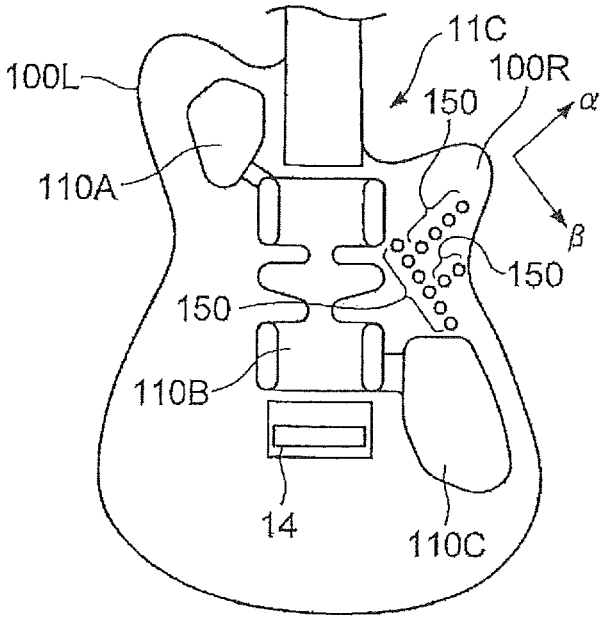
FIG. 7 is a plan view of a body in which a plurality of small holes that are linearly arranged is formed in place of the grooves.

(6) In the illustrated embodiments, the grooves, in other words, holes each extending in the form of a groove, are provided on the body 11, for adjusting the vibration of the body 11 in the intersecting direction that intersects the extending direction in which the strings extend, namely, for adjusting local stiffness of the body in the intersecting direction. In place of the groove-like holes, a plurality of linearly arranged small holes 150 illustrated in FIG. 7 may be provided to adjust local stiffness of a body 11C (FIG. 7). It is considered that provision of the plurality of linearly arranged small holes is also capable of lowering local stiffness of the body 11C while avoiding a considerable reduction in the mass. That is, regardless of the groove-like holes or the plurality of linearly arranged small holes, the holes are provided on part of the body for adjusting the vibration generated in the body supporting the strings in accordance with the vibrations of the strings, so as to adjust the vibration of the body in the intersecting direction that intersects the extending direction of the strings.

(7) In the illustrated embodiments, the principle of the present disclosure is applied to the electric guitar. The principle of the present disclosure is applicable to electric bass guitars. The musical instruments to which the principle of the present disclosure is applicable includes not only electronic musical instruments such as the electric guitars and the electric bass guitars but also musical instruments other than the electronic musical instruments, such as a koto. That is, the principle of the present disclosure is applicable to any musical instrument including the strings, each functioning as the sound generator, and the body supporting the strings, irrespective of the shape of the body, namely, irrespective of whether the body includes a plurality of asymmetrically protruding corner portions. In a case where the body supporting the strings each functioning as the sound generator is formed of a natural material such as wood, the stiffness of the body may be nonuniform due to nonuniformity of the material even if the body is symmetrically formed. Even in such a case, the sounding of the musical instrument can be enhanced by applying the principle of the present disclosure.

What is claimed is:

1. A musical instrument, comprising:

a plurality of strings; and a body having a top exterior surface and supporting the plurality of strings on a first surface of the body, wherein the body includes a groove formed in the first surface that extends linearly, the groove has a constant width and a constant depth, the groove is configured to adjust a vibration of the body, and the groove is formed on the top exterior surface of the body.

2. The musical instrument according to claim 1, wherein the groove extends linearly in a direction that intersects a direction in which the plurality of strings extends.

3. A musical instrument, comprising:

a plurality of strings; and a body having a top exterior surface and supporting the plurality of strings on a first surface of the body, wherein the body includes a groove formed in the first surface that extends linearly, the groove has a constant width and a constant depth, the groove is configured to adjust a vibration of the body in a direction that intersects a direction in which the plurality of strings extends, and the groove is formed on the top exterior surface of the body.

4. The musical instrument according to claim 3, wherein the body includes a plurality of corner portions, and the groove is provided for one of the plurality of corner portions that has a natural frequency higher than natural frequencies of other corner portions.

5. The musical instrument according to claim 4, wherein the one of the plurality of corner portions that has a natural frequency higher than the natural frequencies of other corner portions includes, as the groove: i) a groove extending in a protruding direction of the one of the plurality of corner portions, ii) a groove extending in a direction that intersects the protruding direction, or iii) the groove extending in the protruding direction and the groove extending in the direction that intersects the protruding direction.

6. A musical instrument, comprising:

a plurality of strings; and a body having a top exterior surface and supporting the plurality of strings on a first surface of the body, and a first member fitted in a groove formed in the first surface and having stiffness higher than a stiffness of a portion of the body other than the groove, wherein the groove is formed on the top exterior surface of the body.

7. The musical instrument according to claim 6, wherein the first member is fixed to the body at a portion of the first member embedded in the groove.

8. The musical instrument according to claim 6, wherein the first member includes a first stiffness portion shaped like a plate and having stiffness that is higher than a stiffness of the portion of the body other than the groove.

9. The musical instrument according to claim 8, wherein the first member further comprises a second stiffness portion having stiffness that is lower than a stiffness of the first stiffness portion.

10. The musical instrument according to claim 9, wherein the first member further comprises a third stiffness portion that is shaped like a plate and having a stiffness that is higher than a stiffness of the second stiffness portion.

11. The musical instrument according to claim 10, wherein, in a state in which the first member is fitted in the groove, the first stiffness portion and the third stiffness portion sandwich the second stiffness portion therebetween in a direction of depth of the groove.

12. The musical instrument according to claim 11, wherein, in the state in which the first member is fitted in the groove, the second stiffness portion has a length in the direction of depth of the groove that is larger than a length of the first stiffness portion and a length of the third stiffness portion in the direction of depth of the groove.

13. The musical instrument according to claim 8, wherein the first stiffness portion is formed of carbon fiber reinforced plastic.

14. The musical instrument according to claim 9, wherein the second stiffness portion is formed of wood.

15. The musical instrument according to claim 10, wherein the third stiffness portion is formed of carbon fiber reinforced plastic.

16. The musical instrument according to claim 1, wherein the groove is formed at a position different from a position of a pickup and a position of a bridge on the first surface.

17. A musical instrument, comprising:

a plurality of strings;

a body supporting the plurality of strings on a first surface of the body, and a pickguard provided on the first surface, wherein the body includes a groove formed in the first surface that extends linearly, the groove has a constant width and a constant depth, and the groove is covered by the pickguard in a state in which the pickguard is attached to the first surface, and exposed in a state in which the pickguard is removed from the first surface.

18. A musical instrument, comprising:

a plurality of strings;

a body having a top exterior surface and supporting the plurality of strings on a first surface of the body, wherein the body includes a groove formed in the first surface that extends linearly, the groove has a constant width and a constant depth, and the groove is formed at a position where the plurality of strings do not overlap the groove when viewed in a direction orthogonal to the first surface, and the groove is formed on the top exterior surface of the body.

19. The musical instrument according to claim 1, further comprising a pickguard provided on the first surface, wherein the groove is covered by the pickguard in a state in which the pickguard is attached to the first surface, and exposed in a state in which the pickguard is removed from the first surface.

20. A musical instrument, comprising:

a plurality of strings; and a body supporting the plurality of strings on a first surface of the body, wherein the body includes a groove formed in the first surface that extends linearly, the groove has a constant width and a constant depth, the groove is configured to adjust a vibration of the body in a direction that intersects a direction in which the plurality of strings extends the body includes a plurality of corner portions, and the groove is provided for one of the plurality of corner portions that has a natural frequency higher than natural frequencies of other corner portions.

21. The musical instrument according to claim 20, wherein the one of the plurality of corner portions that has a natural frequency higher than the natural frequencies of other corner portions includes, as the groove:

i) a groove extending in a protruding direction of the one of the plurality of corner portions, ii) a groove extending in a direction that intersects the protruding direction, or iii) the groove extending in the protruding direction and the groove extending in the direction that intersects the protruding direction.

* * * * *